United States Patent [19]

Wey

[11] Patent Number: 4,603,860

[45] Date of Patent: Aug. 5, 1986

[54] TOY OF HONEY-GATHERING BEE

[76] Inventor: Shinn-Hsiung Wey, No. 223, Yeong Fu Road, Tainan, Taiwan

[21] Appl. No.: 731,463

[22] Filed: May 7, 1985

[51] Int. Cl.[4] ..... A63F 9/00

[52] U.S. Cl. ..... 273/1 GD; 273/1 M; 273/140; 446/136

[58] Field of Search ..... 273/414, 1 GD, 1 M, 273/140, 330, 345, 413, DIG. 31; 446/136

[56] References Cited

U.S. PATENT DOCUMENTS

| | | | |
|---|---|---|---|
| 4,214,750 | 7/1980 | Shimizu | 273/1 GD |
| 4,224,761 | 9/1980 | Wakimura | 273/330 X |
| 4,298,199 | 11/1981 | Bush et al. | 273/1 GD |
| 4,432,544 | 2/1984 | Wakimura | 273/1 M |

*Primary Examiner*—William H. Grieb

*Attorney, Agent, or Firm*—Holman & Stern

[57] ABSTRACT

This invention concerns about a kind of toy of honey-gathering bee. It comprises a turning plate in which is placed flowers that are raised up blossoming or lowered down closing according to the uneven height of rails during said turning plate is turning around, a stationary pan on which several pairs of rails are fixed parallel to the circular edge of said pan, and a magnetic honey-gathering bee. Inside each said flower, there is a magnetic pistil which is able to turn around and to jump over and besides, can be angled out by said magnet honey-gathering bee while said flower is raised up with its petals opened; the percentage of successful angling up the pistil is 50, and of course, if said magnetic honey-gathering bee can not escape out of the flower before said flower has sunk down with its petals closed, said bee would be caught inside the flower, and the play will be counted as a failure.

3 Claims, 6 Drawing Figures

TOY OF HONEY-GATHERING BEE

BACKGROUND OF THE INVENTION

It is generally well-known that working bees fly out of their nest for searching and gathering honey from various kinds of flowers. In order to teach children about the fact of hard-working bees, the inventor has worked out this toy, which can give them some educational knowledge as well as an interesting recreation.

DETAILED DESCRIPTION OF THE INVENTION

Figure 1:
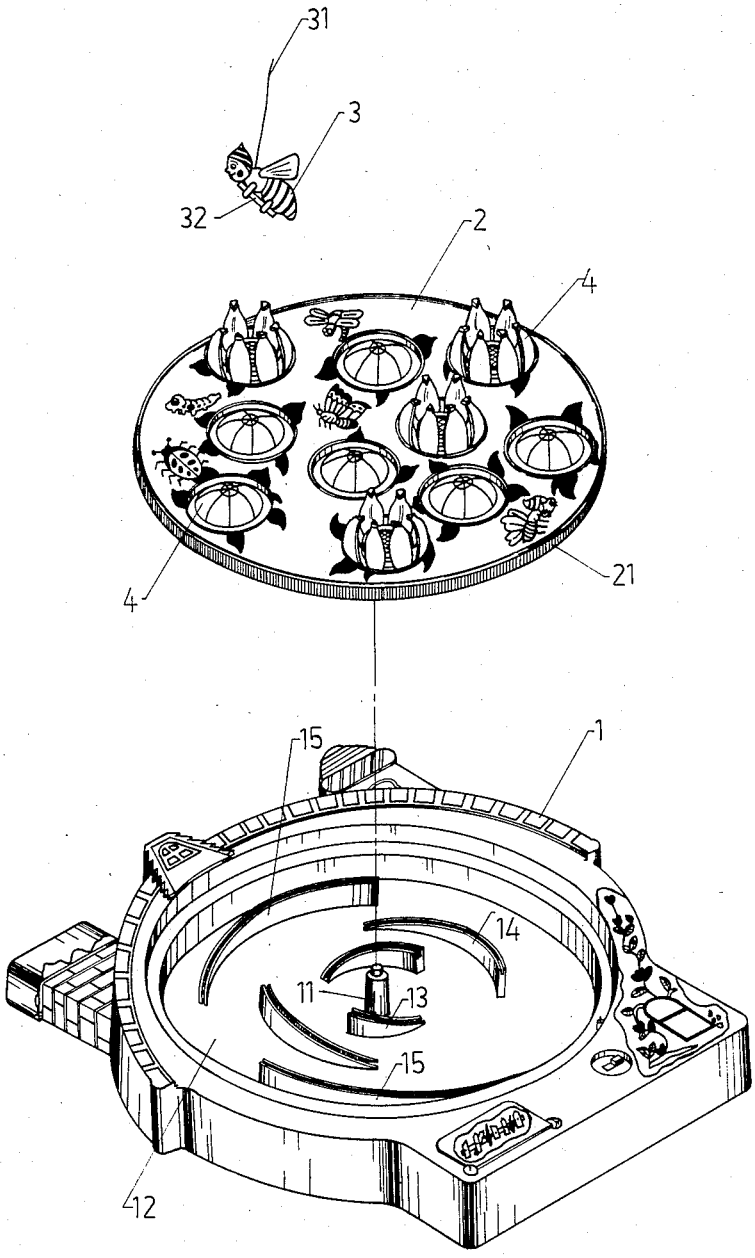
FIG. 1 is the analytical view of the toy of honey-gathering bee in this invention.

This invention, a toy of honey-gathering bee, uses a turning plate having a plurality of cavities, wherein are planted flowers able to open wide or close up depending on the different height of rails mounted on a stationary pan while said turning plate is being turned. Each of said flowers will turn around as synchronously as said turning plate does, and meanwhile, its magnetic pistil inside the flower will also turn around. In said rails are set permanent magnets which will cause said pistil to jump over due to the mutual repulsion of their same polarity. And before said petals are closed up, a magnet honey-gathering bee fastened to a fishing rod with a string can be used to angle up said magnetic pistil utilizing the attractive function of their opposite polarity.

In this invention, at least a pair of rails are mounted on the bottom of said stationary pan. The surface of said rails goes up and down in the same direction, and their curvatures are parallel to the circular edge of said stationary pan. Besides, said rails have a longitudinal ditch on whose outside wall are cut vertical convex stripes. Said permanent magnet is burried in the starting point of the higher part of said rails. And the polarity of the upper part of said permanent magnets of each pair of said rails are opposite to each other.

At the center of said stationary pan is set a support rod for bolstering said turning plate; in order to turn a turning plate, a rubber wheel transmitted by a little motor is convexly set at the edge of said pan.

Said turning plate has a plurality of circular cavities which are located on the trails of said rails and respectively have a wider upper part than its lower part; a notch is cut in the wall and the bottom of the cavity enabling it to pass on said rails while said turning plate is being turned by said rubber wheel.

Said turning plate is put on said stationary pan, supported by said support rod so as to keep the bottom of said cavity from touching the inward bottom of said stationary pan. In addition, said vertical convex stripes cut around its edge are to increase mutual surface friction with said rubber wheel and thus to get easy transmissiom from said rubber wheel.

Said flower comprises several soft flexible petals, each of which uses its extended circular rod formed on two sides of its bottom to join with one of connecting sockets located around the top edge of its receptacle, able to open wide and close up freely. Surrounded by said petals, a support plate is set on said receptacle and its bottom is joined with a cylinder whose upper end is able to pass through the center of said receptacle and whose lower end is able to extend into said ditch of said rail, making said support plate, said receptacle and said cylinder united together as a unit but still enabling said support plate and said cylinder to turn around respectively. Additionally, on the exterior surface of the lower part of said cylinder is cut the same vertical convex stripes as those of said ditch and said magnetic pistil is placed in said support plate.

Said magnetic honey-gathering bee possesses a permanet magnet in its belly, and is fastened to a fishing rod with a string.

Next, an embodiment of this invention is to be described together with illustrating figures as follows.

As shown in FIG. 1, this invention comprises stationary pan 1, turning plate 2 and magnetic honey-gathering bee 3. Said turning plate 2 is supported by support rod 11 and placed in empty space 12 of said stationary pan 1. Said magnetic honey-gathering bee 3 with permanent magnet 32 in its belly is fastened to a fishing rod with a string.

Figure 2:
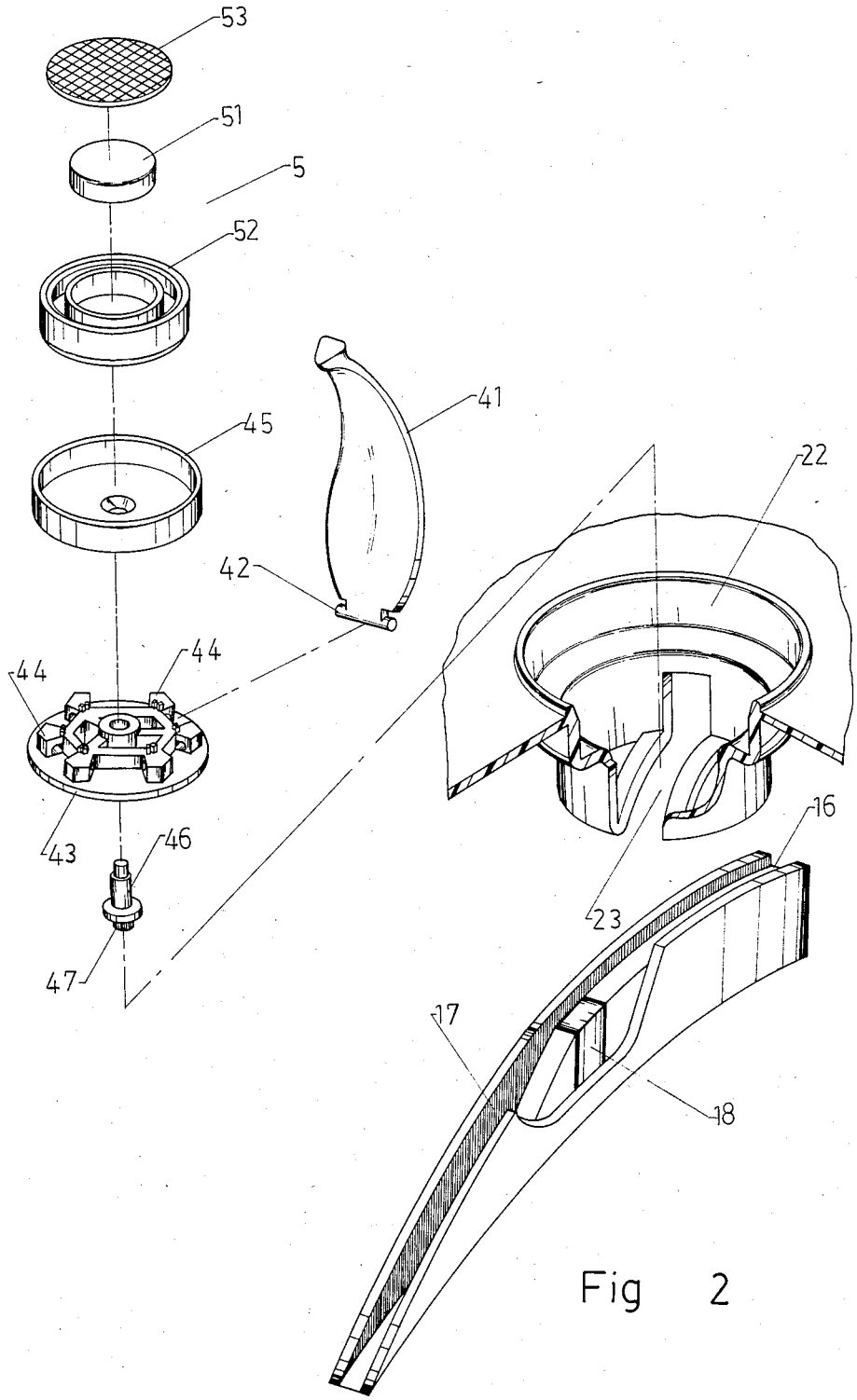
FIG. 2 is the structural view of this toy of honey-gathering bee in this invention.
Figure 4:
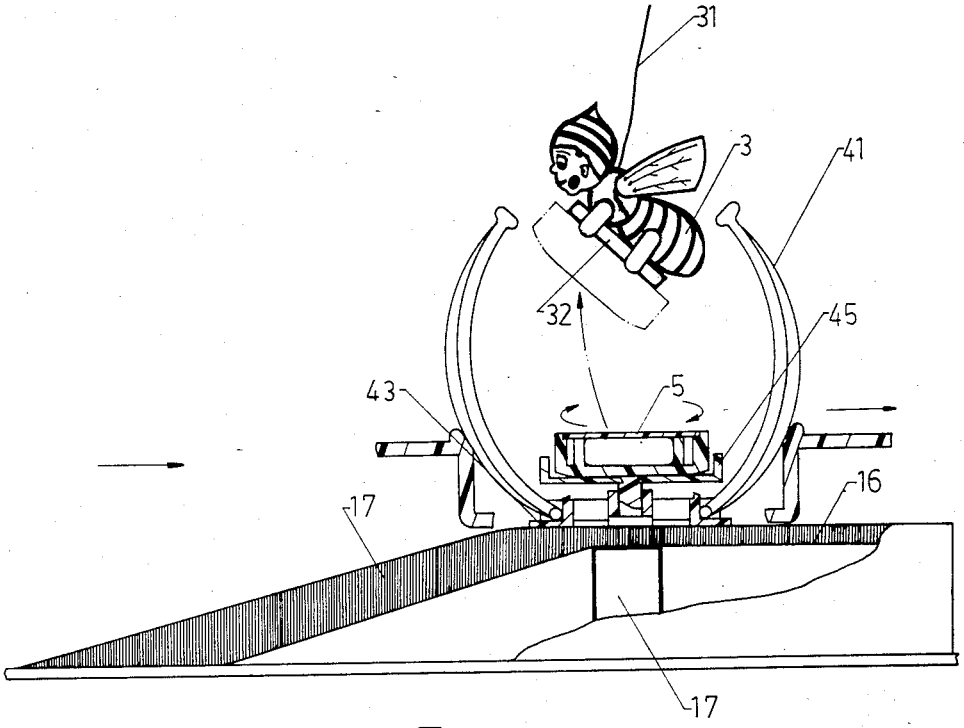
FIG. 4 is the view of playing this toy of honey-gathering bee in this invention.

In addition to said support rod 11 set at the center of said empty space 12 of said stationary pan 1 possesses three pairs of arc-shaped rails 13, 14, 15 whose surfaces go up and down homoligously clockwise and as shown in FIG. 2 or 4, respectively have ditch 16 with vertical convex stripes on its wall. Still in each of said rails is burried permanent magnet 18 at the starting point of its higher part; the polarities of said permanent magnets 18 of each pair of said rails are contrary to each other.

Furthermore, a rubber wheel convexly set at the edge of said empty space 12, is transmitted by a little motor using a battery as power source.

Around the edge of said turning plate 2 are cut vertical convex stripes 21 which are to engage closely with and transmitted by said rubber wheel.

Said turning plate 2, as shown in FIG. 2, has a plurality of cylindrical cavities 22 wherein flowers 4 are respecticely planted and which are located in the trails of said rails 13, 14, 15. In addition, each of them, as FIGS. 2, 3 show, has a wider upper part than a lower part and notch 23 cut diametrically in its bottom and wall, enabling it to pass on said rails 13, 14, 15, while said turning plate is being turned.

Figure 5:
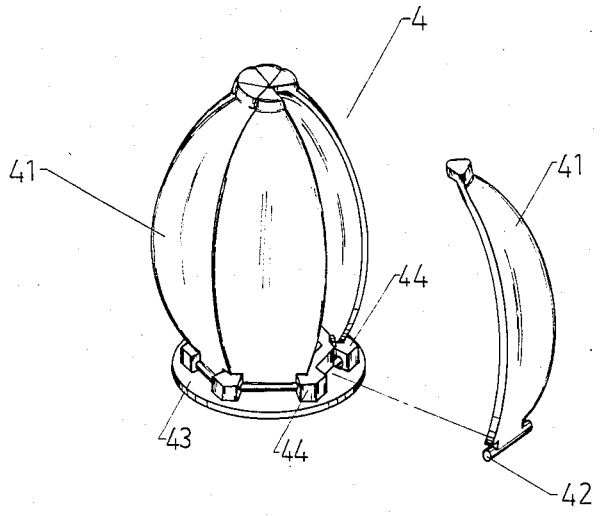
FIG. 5 is the view of the flower closed up in this invention.
Figure 6:
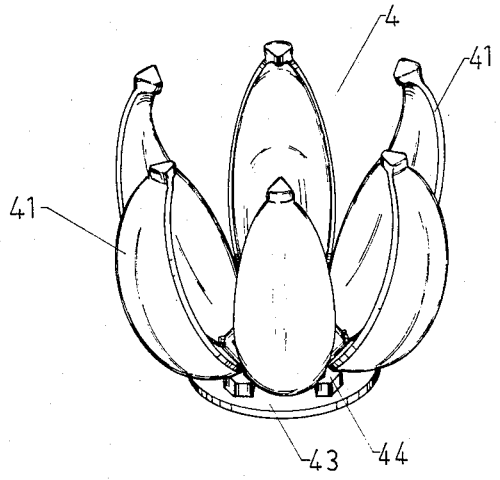
FIG. 6 is the view of the flower opened wide (or blossomed) in this invention.

Said flowers 4, as shown in FIGS. 2, 5, 6 possess several soft flexible petals 41 able to open or close because each of these petals has it cylindrical rod 42 formed on two sides of its bottom for joining with one of connecting sockets 44 placed around the edge of receptacle 43. On said receptacle 43 is mounted a support plate 45 whose bottom center is connected with a cylinder 46 which is to pass through the center of said receptacle 43 with its upper part and to extend into said ditch 16 of said rails 13,14,15 with its lower part, uniting said receptacle 43, support plate 45 and cylinder 46 together as a unit but still enabling support plate 45 and said cylinder 46 to turn around respectively. In addition, vertical convex stripes 47 cut on the exterior surface of the lower part of said cylinder 46 is shaped the same as vertical convex stripes of said ditch 16 so as to engage with said stripes 17 when it passes through said ditch 16.

Magnetic pistil 5 is placed on each said support plate 45 and has in container 52 permanent magnet 51 with one polarity at the upside and the other at the underside, and is covered by a cover 53.

Figure 3:
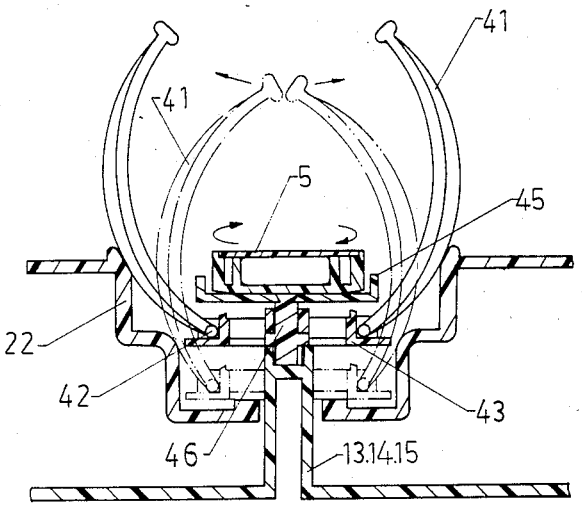
FIG. 3 is the explanatory view of the movement of the flower petals in this invention.

As said turning plate 2 starts to turn around, said flowers 4 will simultaneously rotate sychronously and begin to be raised up gradually and have their petals opened wide gradually when they are passing on said rails 13,14,15, as shown in FIG. 3. Meanwhile, said magnetic pistil 5 and said support plate 45, due to close contact between the lower part of said cylinder 46 and the wall of said ditch 16, will turn around. And as any of said flowers 4 pass on said permanent magnet 18 in said rail 13 or 14 or 15, said magnetic pistil 5 will be repelled to jump over if the polarity of its bottom is the same as that of the top of said permanent magnet 18.

When said petals 41 of said flower 4 are opened wide, said magnetic honey-gathering bee 3 can be lowered down into said flower to angle up said magnetic pistil by means of the magnetic attractive power with a successful probability of 50 percent. If said magnetic honey-gathering bee cannot escape out before said flower reaches the end of said rail and said petals closed up, it is to be counted as a failure.

What is claimed is:

1. A kind of toy of honey-gathering bee including, a stationary pan on which at least a pair of rails with their surfaces rising up and down in the same direction are set; in said each rail is bored a ditch on whose outside wall is cut vertical convex stripes; in the higher part of said each rail is burried a permanent magnet possessing a different polarity for the same pair of rails;

a turning plate, to be placed on said stationary pan, including a plurality of cavities, bored in said plate itself, located along the ways of said rails, which have a wider upper part than the lower part and a notch cut in the bottom and wall in order to pass on said rails;

a flower in each cavity which will open (or blossom) or close up according to the high or low surface of said rail; and a magnetic pistil, placed inside said flower, which will turn over if its underside polarity is the same as that of the magnet in said rails when said flower is passing on said magnet of said rails; and a honey-gathering bee with a permanent magnet hidden in its abdomen, fastened to a fishing rod with a string and used for angling up said magnetic pistil while said petals of said flower are opened widely.

2. A kind of toy of honey-gathering bee as claimed in claim 1, wherein each of said flowers consists of a receptacle and several soft flexible petals which can open wide or close up by means of the cylindrical rods at both its lower sides coupling with the sockets on the circular edge of said receptacle.

3. A kind of toy of honey-gathering bee as claimed in claim 1, wherein said magnetic pistil is placed inside said petals on a support plate connected with a cylinder that sticks through the center of said receptacle and possesses at its lower part an exterior surface with vertical convex stripes which engage with the vertical convex stripes on the outside wall of said rail ditch when said flower passes on said rail; and wherein said magnet pistil itself can turn around in the same way as said support plate and said cylinder do.

* * * * *